US005311677A

United States Patent [19]

Mann et al.

[11] Patent Number: 5,311,677

[45] Date of Patent: May 17, 1994

[54] SHOE HAVING IMPACT ABSORPTION MEANS

[75] Inventors: Ernest S. Mann, Northbrook; Carlos B. Paytuvi, Addison; Roy V. Nolting, Glenview; Thomas F. Riha, Berwyn, all of Ill.

[73] Assignee: Interco Incorporated, St. Louis, Mo.

[21] Appl. No.: 739,882

[22] Filed: Aug. 2, 1991

[51] Int. Cl.[5] ..... A43B 23/00

[52] U.S. Cl. ..... 36/107; 36/35 R; 36/44

[58] Field of Search ..... 36/35 R, 30 R, 37, 12, 36/14, 19.5, 43, 44

[56] References Cited

U.S. PATENT DOCUMENTS

| | | | |
|---|---|---|---|
| 1,718,906 | 6/1929 | Hurley | 36/37 |
| 1,766,311 | 6/1930 | Shaft | 36/35 R |
| 1,919,862 | 7/1933 | Rohn et al. | 36/37 X |
| 1,976,889 | 10/1934 | Everston | 36/37 X |
| 2,045,844 | 6/1936 | Everston | 36/37 X |
| 2,222,391 | 11/1940 | Andreasen | 36/37 X |
| 2,502,774 | 4/1950 | Alianiello | 36/44 X |
| 2,772,488 | 12/1956 | Meltzer | 36/37 X |
| 2,928,193 | 3/1960 | Kristan | 36/44 X |
| 3,233,348 | 2/1966 | Gilkerson | 36/44 |
| 4,932,141 | 6/1990 | Hones | 36/43 |
| 5,084,987 | 2/1992 | Flemming | 36/35 R X |
| 5,105,564 | 4/1992 | Motoda | 36/12 X |
| 5,195,255 | 3/1993 | Coughlin | 36/12 |

*Primary Examiner*—Paul T. Sewell
*Assistant Examiner*—Beth Anne C. Cicconi
*Attorney, Agent, or Firm*—Rogers, Howell & Haferkamp

[57] ABSTRACT

A shoe having an insole with a forepart of leather having the characteristics of upper leather and a back part of fiberboard. A sheet layer of foam material, such as microcellular polyurethane, is cemented to the lower surface of the forepart and a foam cushion, preferably molded of microcellular polyurethane, overlies the back part. The back part of the insole has an opening through it and the foam cushion has a central portion that projects downwardly through the opening thereby providing a thickened foam at the central portion to maximize cushioning at the area of the heel strike. The invention is incorporated in shoes of both the welt-type construction and the cement-type construction.

11 Claims, 4 Drawing Sheets

12
22
28
30
24
34
16
56
62
52
14
26
36
58
64
66
54
50
48

22
26
24
32
48
54
14
12
68
60
62
64
66
56
58
16

48
14
12
16
62
56
58
66
64

48
14
68
60
64
62
56
58

SHOE HAVING IMPACT ABSORPTION MEANS

BACKGROUND OF THE INVENTION

The shoe construction of this invention is related to the incorporation of certain materials in layers at the forepart and back part of an insole to substantially improve the cushioning and therefore the comfort of a shoe.

Improving the comfort characteristics of a shoe is a constant and continuing objective of shoe designers and shoe manufacturers. Among efforts to improve comfort include the incorporation of cushioning in many forms. Some shoes that have cushioning are suitable for informal wear and it is acceptable that the cushioning be visible such as when provided in the construction of the outsole of the shoe. However, if the shoe is intended for dress or formal wear, visible cushioning is not acceptable and it is important that a dress shoe construction be susceptible to any desired design and appearance.

Other efforts to improve comfort have included the incorporation of cushioning in localized areas such as in a central area of the forepart of a shoe. However, such localized cushioning is inadequate to cushion all pressure areas of the front of a wearer's foot.

Still other efforts to improve comfort involve inserts that can be purchased separate from and inserted into a shoe. These inserts are not entirely satisfactory in that they alter the internal size of the shoe by adding height to the inner floor, they shift positions during wearing, they do not accurately fit the shoe, they are difficult to manipulate inside a shoe, they fall out of a shoe, and they do not provide optimum cushioning in the proper areas of the shoe.

The present invention creates cushioning that is built into the shoe and that avoids the disadvantages of the prior efforts.

SUMMARY OF THE INVENTION

The shoe of the present invention is described and illustrated in two embodiments. Both embodiments incorporate an insole having a forepart and a back part in which the forepart is made of shoe upper leather and the back part is made of fiberboard having an opening through it. At the forepart, there is a sheet of foam material, such as microcellular polyurethane, glued to the under surface and extending over the entire area of the forepart that is contacted by the front part of a wearer's foot. At the back part of the insole, there is a central opening and a foam cushion is connected to and overlies the back part of the insole. The foam cushion has a central projection that projects downwardly through the opening, providing a thicker cushion at the area of strike of the wearer's foot.

The combination of the upper leather layer and the microcellular urethane sheet at the forepart provides a very comfortable cushioning effect against downward impact over the entire front portion of the wearer's foot. At the back part, the microcellular polyurethane overlying the fiberboard provides cushioning for the entire heel area and the thicker central section provided by the projection through the opening in the back part provides maximum cushioning against the impact over the strike area of the heel.

One embodiment of the invention, a shoe of welt construction, has a tape rib projecting downwardly from the insole defining a cavity, which is where the microcellular polyurethane sheet is located. In another embodiment, a shoe of cement construction, the sheet of microcellular polyurethane is located over the area within the lasting margin of the upper.

DESCRIPTION OF THE PREFERRED EMBODIMENTS

Figure 1:
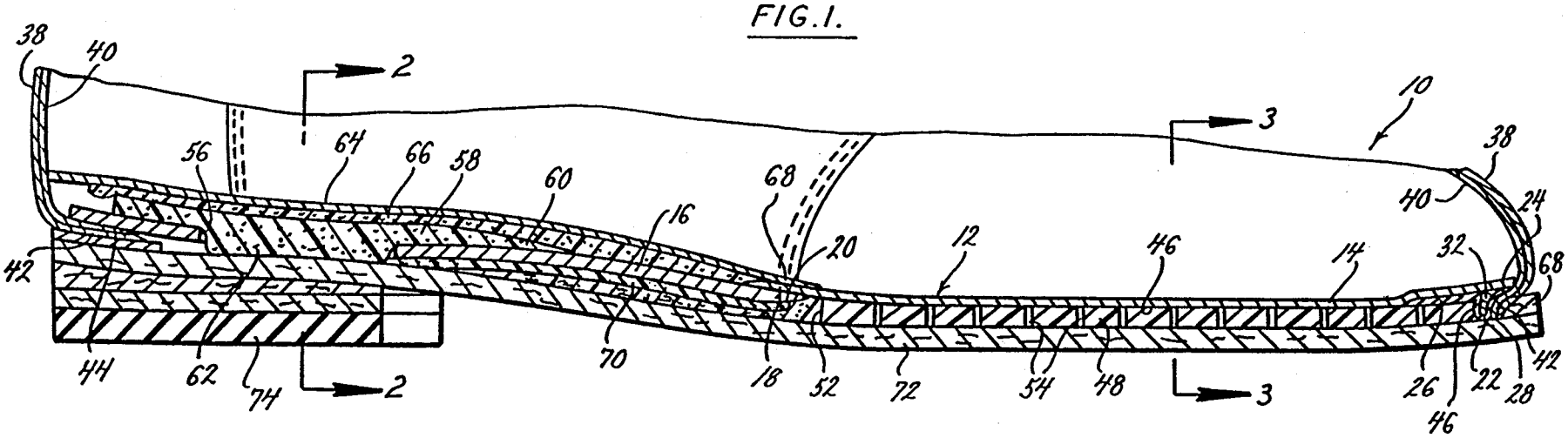
FIG. 1 is a view in longitudinal medial section through the lower portion of a shoe of welt construction.
Figure 3:
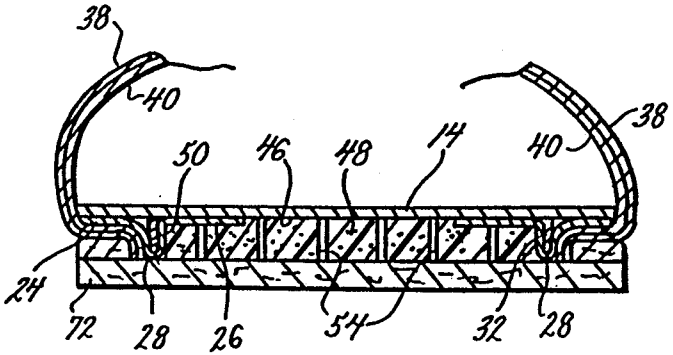
FIG. 3 is a view in section taken along the plane of the line 3—3 of FIG. 1.
Figure 2:
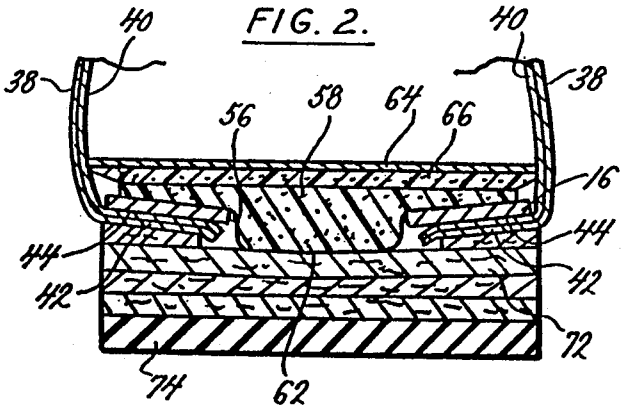
FIG. 2 is a view in section taken along the plane of the line 2—2 of FIG. 1.

In one embodiment of the invention, illustrated in FIGS. 1 through 5, a shoe 10 is of welt construction. The shoe 10 incorporates an insole 12 having a forepart 14 and a back part 16. In this invention, the forepart is made of the kind of leather used for a shoe upper. Shoe upper leather is softer and more flexible and pliable than other leathers. Its thickness typically ranges from about three and one half to about four ounces. This contrasts to leather lining material the thickness of which typically ranges between about one and about two ounces and contrasts to leather sole material the thickness of which is typically a minimum of nine iron. This leather forepart 14 has a lacquered surface so that cement will stick to it but will not penetrate the leather.

Figure 4:
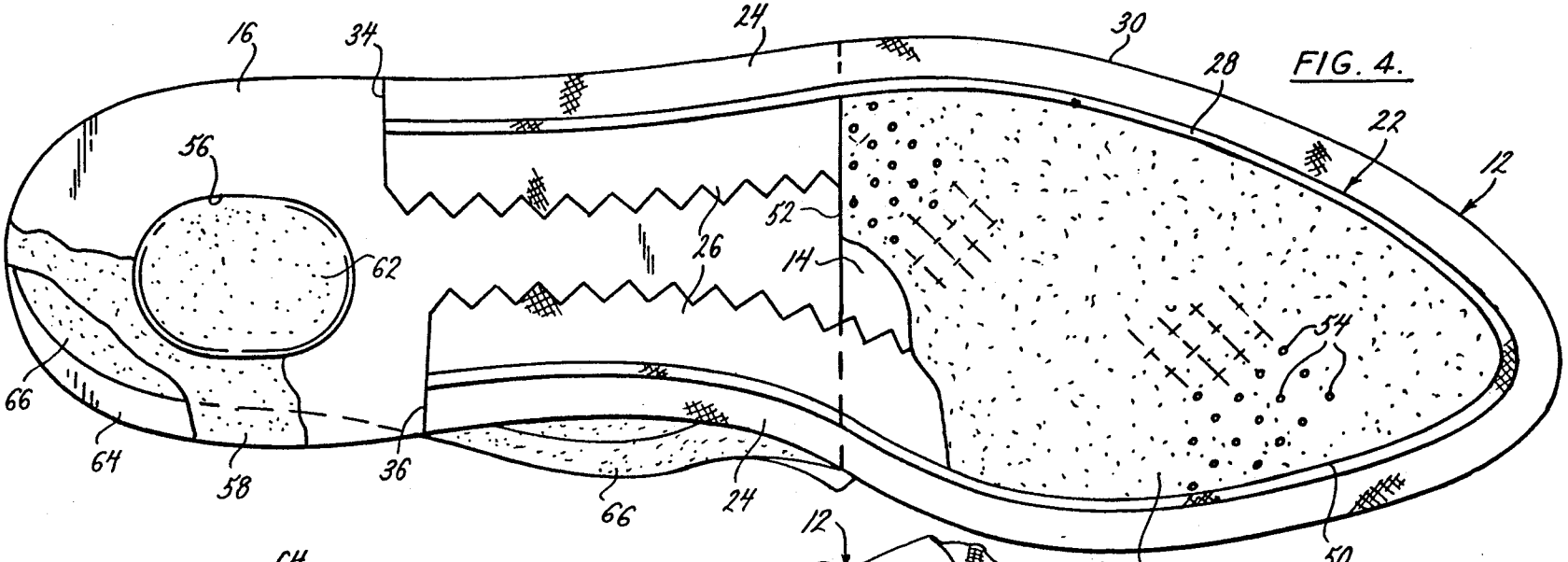
FIG. 4 is a bottom view of the insole with the rib tape, forepart foam layer, and back part foam cushion installed.
Figure 5:
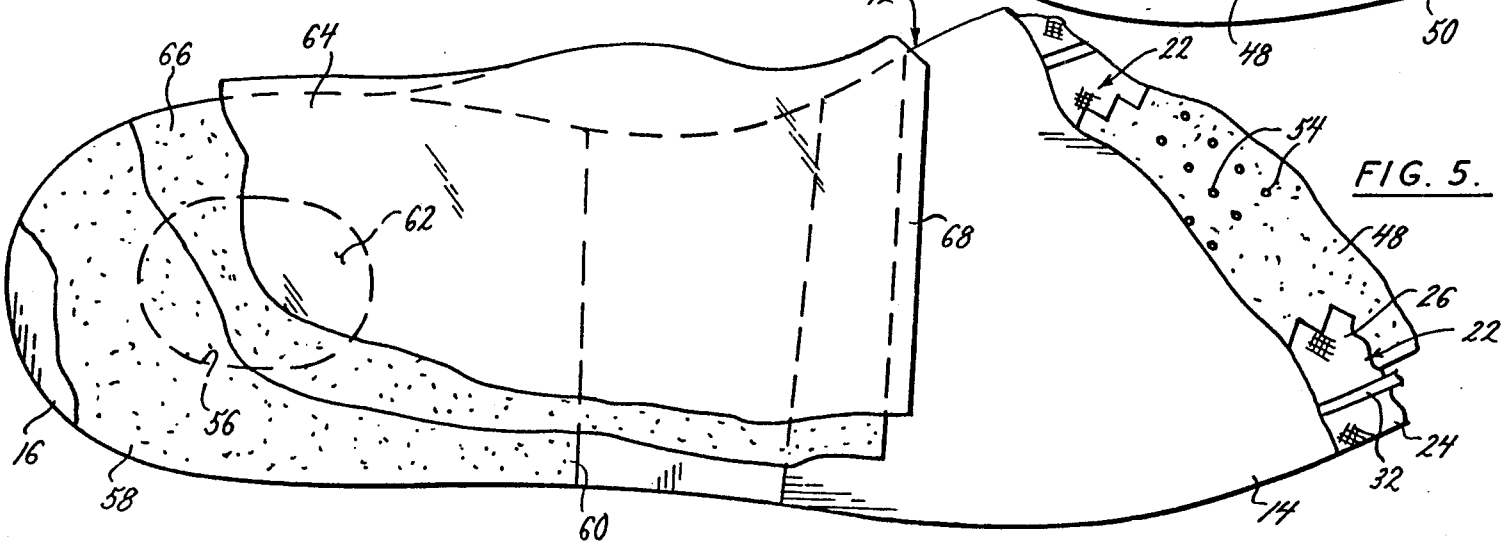
FIG. 5 is a partial top view of the assembled components of FIG. 4.

The back part 16 of the insole 12, unlike the forepart 14, is made of a stiff material, such as fiberboard. Its thickness is about five iron. The forepart leather layer 14 has a feathered rear margin 18 and the back part layer 16 has a feathered front margin 20; the margins are cemented together. This shoe being of welt construction, has a continuous tape strip 22, that has flanges 24 and 26 by which the tape is applied and adhered by a standard heat/cement process to the insole 12, locating its downwardly projecting rib 28 spaced inwardly from the outer edge 30 of the insole, as shown in FIG. 4. As is conventional, the rib 28 is provided with the usual stiffener 32. The terminal ends 34 and 36 are near the front of the heel area of the insole.

A shoe upper 38 (with a liner 40) has a lasting margin 42 cemented in the conventional manner to the outer side of the rib 28 and its flange 24 and to the lower peripheral margin 44 of the back part 16 of the insole 12. The construction and form of the upper and components incorporated in it are conventional.

The area within the rib 28 defines a cavity 46, and within this cavity 46, a foam layer 48 is cemented to the forepart 14 of the insole 12. The foam layer 48 is of microcellular polyurethane construction, such as that identified by the trademark PORON and sold by Rogers Corporation of East Woodstock, Conn. Preferably the foam layer 48 is about ⅛ inch thick. It is important that the foam layer be compressible and resilient with substantially 100% memory over the life of the shoe. The foam layer 48 has continuous forward and side edges 50 that extend about to the rib 22 and its rear edge 52 is at about the line where the instep begins. Thus the foam layer 48 lies below and can cushion all areas of the foot, forward of the instep, that exert downward pressure on the insole. The foam layer 48 may be provided with a plurality of holes 54 through it spaced over its entire area to influence the compression characteristics of the foam layer 48.

The back part 16 of the insole has an oval shaped opening 56 through it located directly below the area where the wearer's heel exerts maximum downward pressure. The opening 56 is in the range of one and one half inches long and one and one eighth inches wide. A foam cushion 58 has a tapered forward margin 60 that is cemented to the back part 16 of the insole 12. The foam cushion 58 has a central projection 62 that extends downwardly through the opening 56. The uncompressed thickness of the foam cushion 58, not including the central projection 62, is about 3/16 inch thick and the central portion 62 projects downwardly by a distance of about ⅛ inch, making the overall thickness in the area of central projection about 5/16 inch thick. The foam cushion 58 is also preferably of microcellular polyurethane, but is molded rather than being provided in sheet form as is the case of the foam layer 48.

A leather sock liner 64 with a conventional sponge cushion 66 cemented to it has a forward margin 68 where the liner is cemented to the insole 12.

The rest of the shoe construction is conventional, including the provision of a welt 68 sewed in place, a shank 70 cemented in place with cork filler alongside the shank 70, an outsole 72, and a heel 74, attached in conventional manners.

Figure 6:
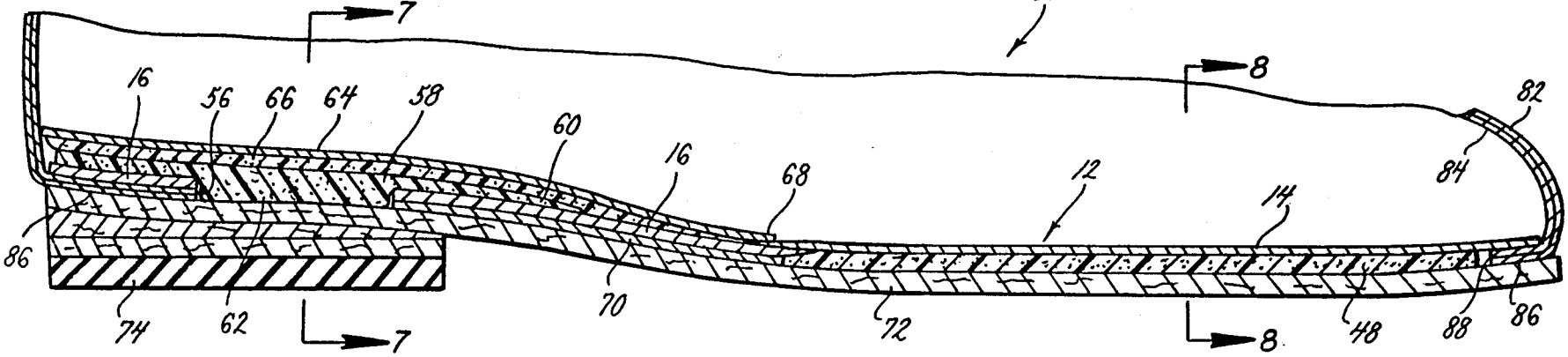
FIG. 6 is a view in longitudinal medial section through the lower portion of a shoe of cement construction.
Figure 8:
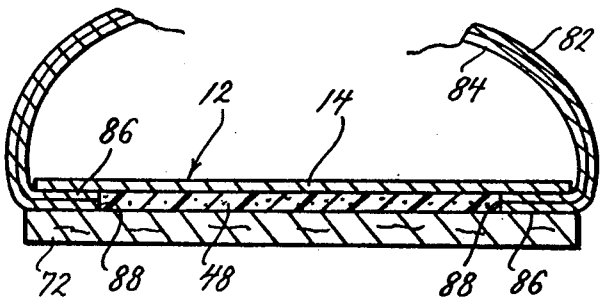
FIG. 8 is a view in section taken along the plane of the line 8—8 of FIG. 6.
Figure 7:
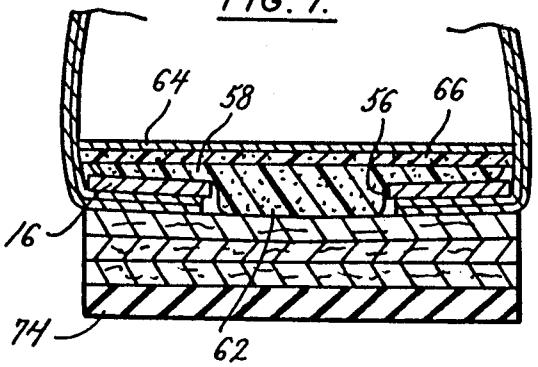
FIG. 7 is a view in section taken along the plane of the line 7—7 of FIG. 6.
Figure 9:
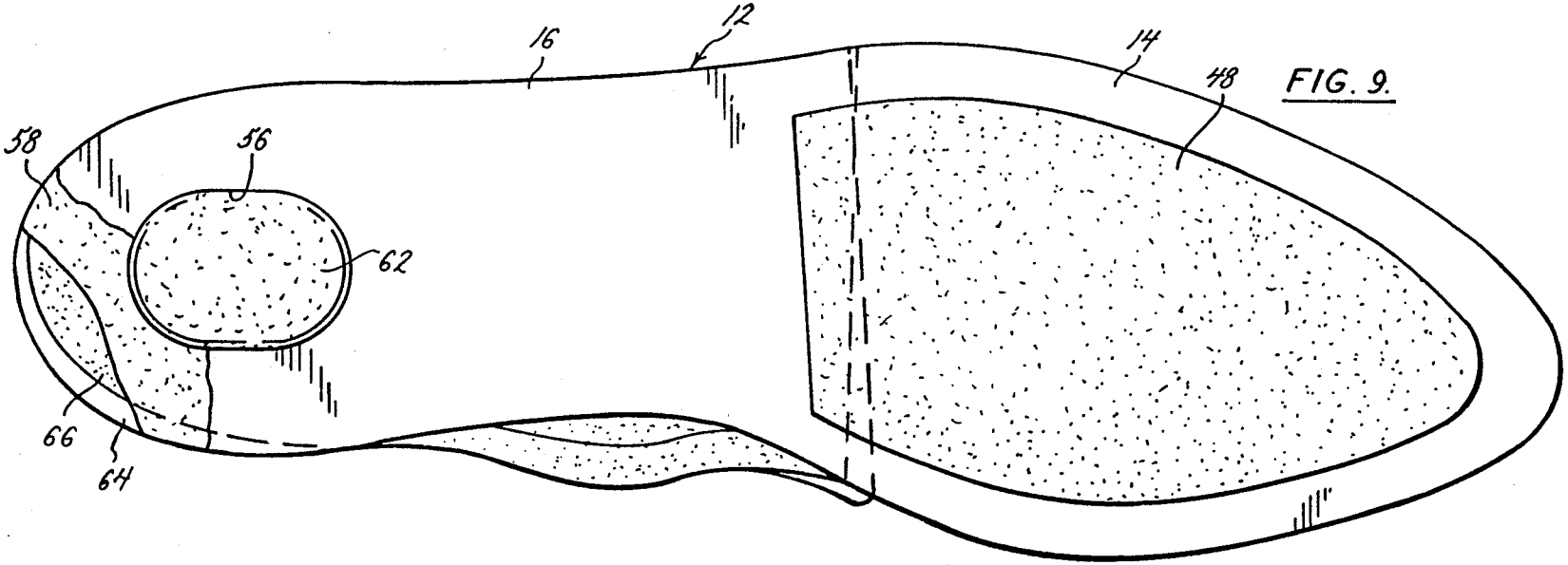
FIG. 9 is a plan view of the insole with the forepart foam sheet and the back part foam cushion installed.
Figure 10:
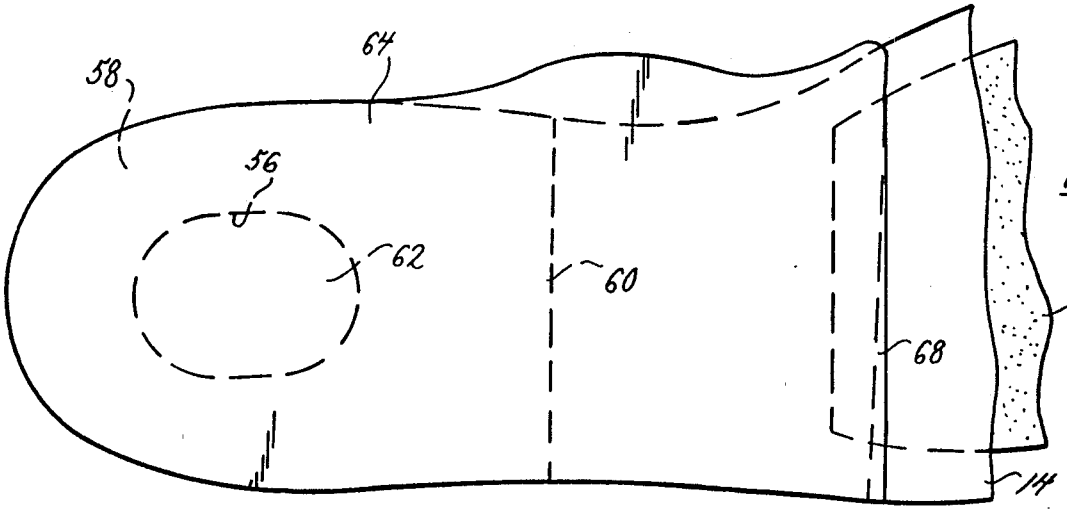
FIG. 10 is a partial top view of the assembly of FIG. 9.

In another embodiment of the invention, FIGS. 6 through 10 illustrate a shoe 80 of cement construction. The shoe 80 has the same insole 12 with its leather forepart 14 and fiberboard back part 16 having the opening 56 through it. However, there is no tape 22 and an upper 82 with its sock liner 84 has its lasting margin 86 cemented to the outer margin of both the forepart 14 and the back part 16 of the insole 12. The inner edge 88 of the lasting margin 86 defines an area within which a foam layer 48 of the kind previously described lies, cemented to the forepart 14. Also, the same foam cushion 58 as previously described has its forward margin 60 cemented to the back part 16 and its central projection 62 extending downwardly through the opening 56 in the back part 16, all as illustrated in FIGS. 6 through 8. This shoe also includes the sock liner 64 and its cushion 66 with the sock liner having a forward margin 68 cemented to the back part 16, includes a shank 70 and an outsole 72 and heel 74, all attached in the manner that is conventional for a cement construction shoe.

The shoe is made by providing an insole 12 having a forepart 14 of shoe upper leather that is softer and more flexible and pliant than other leathers, including sole leather, and that has a thickness of between about 3½ ounces and about 4 ounces; and having a back part 16 of stiff material such as fiberboard having a thickness of about 5 iron. The rear margin 18 of the forepart is feathered and the front margin 20 of the back part is feathered and the two feathered margins are cemented together. In a welt construction shoe a continuous tape strip 22 is adhered to the insole 12 by a standard heat/cement process, with the downwardly projecting rib 28 spaced inwardly from the outer edges 30 of the insole. In a cement construction shoe the upper is drawn over a last and the lasting margin 86 of the upper is adhered to a peripheral area of the insole. In both shoe constructions an opening or hole 56 is provided through the back part. The hole or opening 56 is oval shaped and is located directly below the area where the wearer's heel will exert maximum downward pressure when the shoe is worn. A foam cushion 58 is molded of microcellular polyurethane and is formed with a central downward projection 62 having an uncompressed thickness below the lateral margin of the foam cushion of about ⅛ inch, with the lateral portion surrounding the projection being about 3/16 inch. Once located, the foam cushion is secured to the insole by cementing its forward margin to the insole.

A resilient foam pad is cut from a sheet of microcellular polyurethane of about ⅛ inch thickness to a size and shape to fit in the area of the forepart within the lasting margin of a cement construction shoe and is adhered to the insole. In the welt construction shoe, the resilient pad is located is the area of the forepart within the downwardly projecting rib. An outsole and heel are joined to the insole in the conventional manner.

In use, the shoe provides extraordinary comfort to the foot of a wearer. The soft leather of the forepart 14 of the insole 12 cooperates with the foam sheet 48 to cushion the entire front part of the foot. When the resilient foam sheet 48 yields and compresses, the insole forepart 14, being pliable, follows the changing contour of the foam sheet while at the same time helping to distribute concentrated loads applied by the foot. Yet although it is rigidly pliable and is soft, the insole forepart 14 is thick enough to endure and last for the life of the shoe.

The molded foam cushion 58 cushions the entire heel of the foot. Moreover, at the strike area where the pressure is greatest, the added thickness of the projection 62 cooperating with the opening 56 that accommodates the projection further cushions that area of concentrated pressure.

The sheet and molding cushion being of microcellular polyurethane, results in cushioning that is yielding and resilient with dependable and complete memory. This foam is fully self restoring and will not lose its resiliency for the life of the shoe.

While the present invention has been described by reference to specific embodiments, it should be understood that modifications and variations of the invention may be constructed without departing from the scope of the invention defined in the following claims.

What is claimed is:

1. A shoe comprising:

an upper portion, an insole joined to the upper portion, and an outsole portion joined to the insole portion, the insole portion have a forepart comprising a layer of shoe upper leather of a thickness in the range of at least 2½ ounces and less than 5 ounces and a layer of foam material, the forepart having a back margin, the foam layer being located between the leather layer and the outsole and extending over substantially the entire area directly below the insole forepart of the shoe, the insole portion having a back part comprising a layer of generally stiff material extending over the heel area of the shoe and having a front margin, means for adhering the front margin of the back part to the back margin of the forepart thereby forming a composite insole having a forepart of upper leather within said range of thickness and a back part of generally stiff material, an opening through the layer of stiff material in the central portion of the heel area, and a foam cushion overlaying the back part of the insole and having a thickened central area projecting into and through the opening in the back part whereby the strike impact of the heel of a human foot wearing the shoe will be at the thickened central area.

2. The shoe of claim 1 wherein:

the layer of generally stiff material of the back part of the insole is fiberboard, the forepart of the insole having a rear margin bonded to said front margin.

3. The shoe of claim 1 wherein:

the thickness of the layer of generally stiff material of the back part of the insole is between about 4 iron and about 6 iron.

4. The shoe of claim 1 wherein:

the uncompressed thickness of the layer of foam material is between about 3/32 inch and 5/32 inch.

5. The shoe of claim 1 wherein:

the shoe is a cement construction.

6. The shoe of claim 1 wherein:

the shoe is a welt construction.

7. The shoe of claim 1 wherein:

the thickness of at least most of the foam cushion excluding the thickened central area, is between about 5/32 inch and 7/32 inch, and the depth of the thickened central area projecting below the foam cushion is about the same as the thickness of the layer of stiff material.

8. The shoe of claim 1 wherein:

the foam cushion is molded microcellular polyurethane.

9. A method of making a shoe comprising the steps of:

providing an insole having a forepart and a back part wherein the forepart is of upper leather the thickness of which is between about two ounces and five ounces and the back part is of a material stiffer than that of the forepart, adhering a rear margin of the forepart to a front margin of the back part, providing a hole through the back part opening through the top and bottom surface thereof, forming a foam cushion having a generally flat central projection sized to fit through the hole and having a depth substantially equal to the depth of the hole between the top and bottom surfaces of the back part, locating the foam cushion over the back part with the central projection directed downwardly through the hole, securing the foam cushion to the insole in the located position, drawing an upper over a last and adhering a lasting allowance of the upper to a peripheral area of the insole, locating a sheet of foam within the area of the forepart and adhering the sheet of foam to the insole, and adhering an outsole and heel to the insole.

10. The method of claim 9 wherein:

the insole includes a downwardly projecting rib around a peripheral margin of its forepart, and the locating step includes locating the sheet of foam within the boundary defined by the rib.

11. The method of claim 9 wherein the foam cushion is molded microcellular polyurethane.

* * * * *